US005722390A

United States Patent [19]

Hannebaum

[11] Patent Number: 5,722,390

[45] Date of Patent: Mar. 3, 1998

[54] FIREPLACE WOOD HOLDER

[76] Inventor: Harold W. Hannebaum, P.O. Box 437, Bellevue, Id. 83313

[21] Appl. No.: 727,276

[22] Filed: Oct. 8, 1996

[51] Int. Cl.[6] ..... F24B 3/00

[52] U.S. Cl. ..... 126/541; 126/152 R; 126/152 B

[58] Field of Search ..... 126/540, 541, 126/152 R, 152 B, 162, 169; 110/196, 241, 294; 248/133, 139, 140, 142

[56] References Cited

U.S. PATENT DOCUMENTS

| | | | |
|---|---|---|---|
| 174,650 | 3/1876 | Williams | 126/541 |
| 704,359 | 7/1902 | McGurrin . | |
| 1,309,012 | 7/1919 | Brandfon | 297/310 |
| 3,499,432 | 3/1970 | Hannebaum | 126/120 |
| 4,181,117 | 1/1980 | Hannebaum | 126/120 |
| 4,273,096 | 6/1981 | Hannebaum | 126/120 |
| 4,332,235 | 6/1982 | Hannebaum | 126/120 |
| 4,651,708 | 3/1987 | Groenweg | 126/30 |
| 5,042,716 | 8/1991 | Robbins | 248/133 |
| 5,076,253 | 12/1991 | Lindstro | 126/540 |

FOREIGN PATENT DOCUMENTS

| | | | |
|---|---|---|---|
| 4949 | of 1910 | United Kingdom | 126/541 |
| 470822 | 8/1937 | United Kingdom | 126/501 |
| 2025031 | 1/1980 | United Kingdom | 110/241 |

*Primary Examiner*—Carl D. Price
*Attorney, Agent, or Firm*—Craig M. Korfanta

[57] ABSTRACT

A fireplace wood holder which holds firewood in a vertical position so that the firewood's fibers and water-conducting channels are oriented substantially up and down to allow more complete burning and combustion, and therefore more efficient heat and mass transfer and subsequently a more efficient combustion of the wood. Additionally, the wood holder can be tilted into a filling position to provide a convenient method of adding fuel to the fire.

6 Claims, 6 Drawing Sheets

FIREPLACE WOOD HOLDER

BACKGROUND OF THE INVENTION

1. Field of the Invention

This invention relates generally to fireplaces and stoves. More specifically, this invention relates to a holder for orienting wood and other combustibles to be burned in a fireplace or stove in a vertical position.

2. Related Art

There is an ever increasing environmental need and awareness to consume all forms of energy in as an efficient a manner as possible. This need and awareness holds true as well for all designs of wood-burning fireplaces and stoves which remain popular in current times. There continues to be both a need and a corresponding effort to reduce smoke emissions from wood-burning fireplaces and stoves through the increased efficiency of combustion of the wood. There is the additional benefit of conservation of firewood where efficiency of combustion of the wood is maximized.

Historically, firewood has been laid on its side in fireplaces, that is oriented horizontally, for burning. Typically, firewood has been laid on iron holders, known as grates in this horizontal orientation for combustion. These holders serve as horizontal racks, and most often elevate the firewood for allowing more efficient air flow to the fire.

Also, these horizontal racks may have spaced-apart vertical posts, or other abutments, for example, near their corners which serve to prevent firewood from rolling out of the fire.

A number of patents have developed the theory of the desirability of generating a vertical draft in the fireplace or wood burning stove.

U.S. Pat. No. 3,499,432 (Hannebaum '432) discloses a freestanding heating unit having a fixed fire spreader, or baffle. In the unit, selected glass panes define a plurality of elongated, vertical air intake openings extending the entire length of the panes. The unit also has a concentric ring mounted on the top end of the glass panes to prevent inlet air from adding to the updraft and heated air from circling against the glass sidewalls.

U.S. Pat. No. 4,181,117 (Hannebaum '117) discloses a fireplace heating unit having adjustable louvers mounted on the border of the outlet hood. The louvers are flat vanes oriented over a series of openings to force the air flowing into the interior of the heating unit in a downward direction.

U.S. Pat. No. 4,273,096 (Hannebaum '096) discloses a fireplace heating unit having a top section with a horizontal peripheral border. Integral with the border is a plurality of openings that are partially blocked by louvers. Hinged flaps are attached outside the louvers to control the amount of air passing into the heating unit. The louvers are in the form of a flat vane and cause the inlet air to swirl into the fire place along the inner surface of the glass. Hannebaum '096 discloses an embodiment wherein the top section is displaced from the frame to form a peripheral air intake slot. Each slot is partially blocked by a continuous vane shaped in a way to deflect the vertical flow of intake air into a horizontal clockwise flow.

U.S. Pat. No. 4,332,235 (Hannebaum '235) discloses an enclosed fireplace mounted on a pedestal. The fireplace has a plurality of vertical air intake tubes drawing air from the base of the pedestal. Also, the fireplace has a wood holder comprising a series of horizontal rings and vane shaped legs. Each leg has a flat, thin, generally vertical strip, the primary purpose of which is to direct air approaching the wood holder into a specific rotational flow within the wood holder.

Still, there is a need for a simple wood holder or grate which may be employed in a fireplace or a woodstove of any configuration which allows the firewood or other combustible material to be oriented in a vertical position to be burned in the fireplace or woodstove.

SUMMARY OF THE INVENTION

Accordingly, the present invention is a vertical wood holder which holds the firewood or other combustible material in a vertical position in a fireplace or woodstove for better burning. The vertical position is defined herein to mean an orientation wherein the wood is placed so that its fibers and water-conducting channels are oriented substantially up and down, compared to crosswise. This orientation allows a more complete, thorough and therefore efficient heat and mass transfer and subsequently better combustion of the wood.

Broadly speaking, the vertical wood holder is any generally open container whose major dimension is parallel in the vertical axis to the fibers and water-conducting channels of the wood placed therein. "Generally open" is defined herein as meaning able to allow oxygen to pass across the perimeter of the container to become accessible to the wood.

The advantages of the vertical wood holder include minimization of smoke generated by wood burning; more efficient mixing of the hot gasses and oxygen in the fire; an increase of heat generated by the fire with less firewood used; a noticed decrease of chimney fires due to more efficient and complete combustion of gasses in the firebox and the resulting decrease of soot in chimneys; and fewer unburned log portions, which are typical of standard horizontal grates.

The vertical wood holder can be used in any type fireplace with a large opening, including conventional stone or masonry type fireplaces and by using one, two or three or more vertical wood holders together in a straight row to have a smokeless chimney. It can also be used in free standing, carousel type fireplaces as well.

In the preferred embodiment of the invention, the vertical wood holder may be made in any suitable height for a given fireplace or stove, with the diameter of vertical wood holder of approximately nine to ten inches. This keeps the wood burning in an up-right position, and helps to keep the wood from falling apart as it burns. Preferably, the vertical wood holder comprises a vertical series of horizontal rings joined by a plurality of hollow, vertical legs. The bottom ring is provided with a horizontally oriented grate to keep the logs or other fuel from falling out of the bottom of the wood holder.

Additionally, the preferred embodiment of the invention includes at least three legs which offset the bottom of the vertical wood holder from the floor of the firebox by two to three inches allowing a draft of air to enter from the bottom of the fire, and up around the sides of the wood as it burns in a vertical flame thus creating a vacuum drawing more air into the flames.

A handle is provided which is removably attachable to the vertical wood holder to allow the user to engage the vertical wood holder while in use and position the apparatus for reloading. Additionally, the legs of the vertical wood holder are arranged to allow the vertical wood holder to be tilted forward to accommodate loading and a portion of the top most ring is cut away to facilitate loading of the wood holder from the front.

Other modifications include: increasing the number of rings and decreasing their relative spacing and/or providing various degrees of expanded metal or similar shielding attached around the periphery of the holder will help prevent small embers from falling out of the wood holder during burning and reloading; providing a pivotal stub leg to form a tripod support system for loading; and providing a hinge connected between the wood holder and the firebox to stabilize the wood holder during tilting.

DESCRIPTION OF THE PREFERRED EMBODIMENTS

Figure 1:
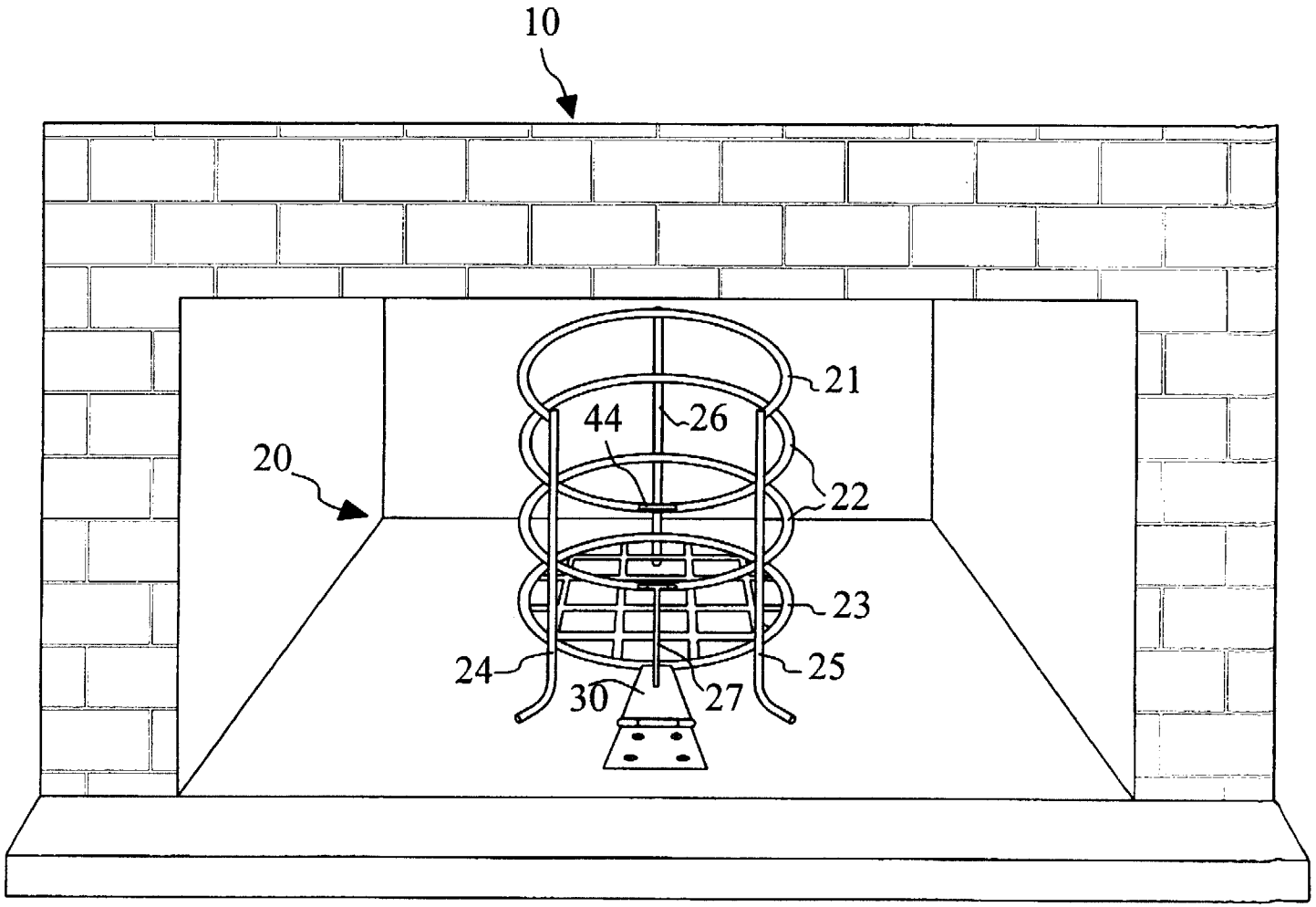
FIG. 1 is a perspective view of the currently preferred embodiment of the invention.
Figure 2:
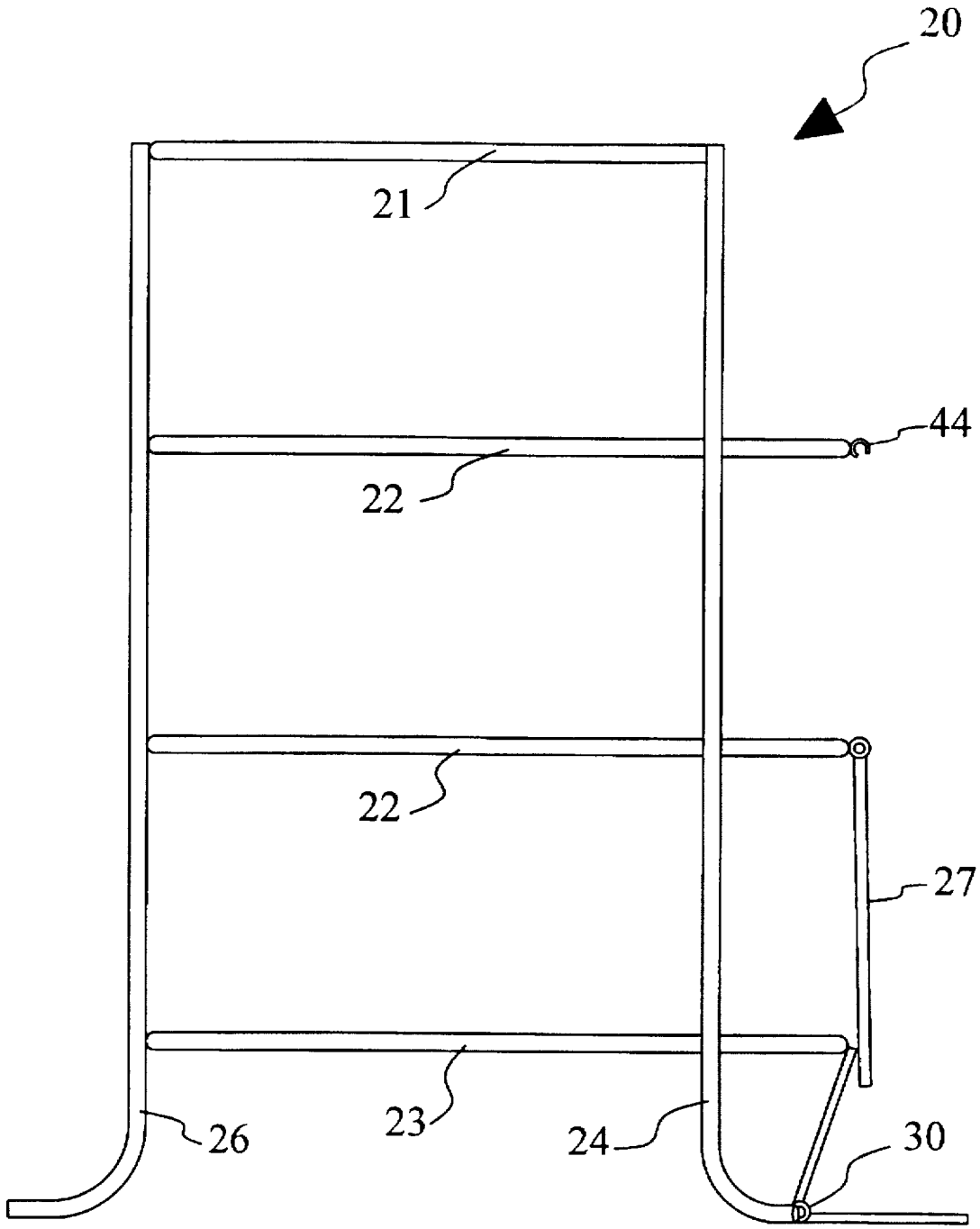
FIG. 2 is a side view of the embodiment depicted in FIG. 1.

Referring to the figures, there is shown fire enclosure 10 having vertical wood holder 20 centered in it. The preferred vertical wood holder 20 is formed by a plurality of horizontally spaced concentric rings shown in the Figures at 21, 22 and 23. The concentric rings, upper most ring 21, middle rings 22 and bottom ring 23 are attached to a plurality of legs shown in the Figures at 24, 25 and 26 at the outside edges of the rings by conventional means such as welding. As mentioned earlier, increasing the number of rings and decreasing their relative spacing and/or providing various degrees of expanded metal or similar shielding attached around the periphery of the holder will help prevent small embers from falling out of the wood holder during burning and reloading.

As shown in the Figures, the front segment of the uppermost concentric ring 21 is cut away to facilitate placement of firewood in vertical wood holder 20. Preferably, the ends 30 and 31 of segmented uppermost concentric ring 21 terminate and are connected to legs 24 and 25. The fuel capacity of the vertical wood holder 20 is limited by the diameter of concentric rings 21, 22 and 23.

Legs 24, 25 and 26 can be formed using solid metal rod or metal pipe or tubing. In the case where pipe or tubing is used, each leg 24, 25 and 26 has an aperture in the bottom end of the pipe or tubing and at its top end. When legs 24, 25 and 26 are attached to the horizontal concentric rings 21, 22 and 23, the aperture faces outward allowing air to flow into the pipe or tubing through the opening at the bottom end of the leg and out the top end. This configuration allows oxygen to be introduced at the top of the flames for aiding in the combustion of any smoke that maybe there. Additionally, air flow through legs 24, 25 and 26 helps cool vertical wood holder 20 by drawing heat away from the metal horizontal concentric rings 21, 22 and 23 and legs 24, 25 and 26, reducing the stresses within the metal components forming vertical wood holder 20. By reducing the stresses, vertical wood holder 20 retains its shape and has a longer life.

Figure 6:
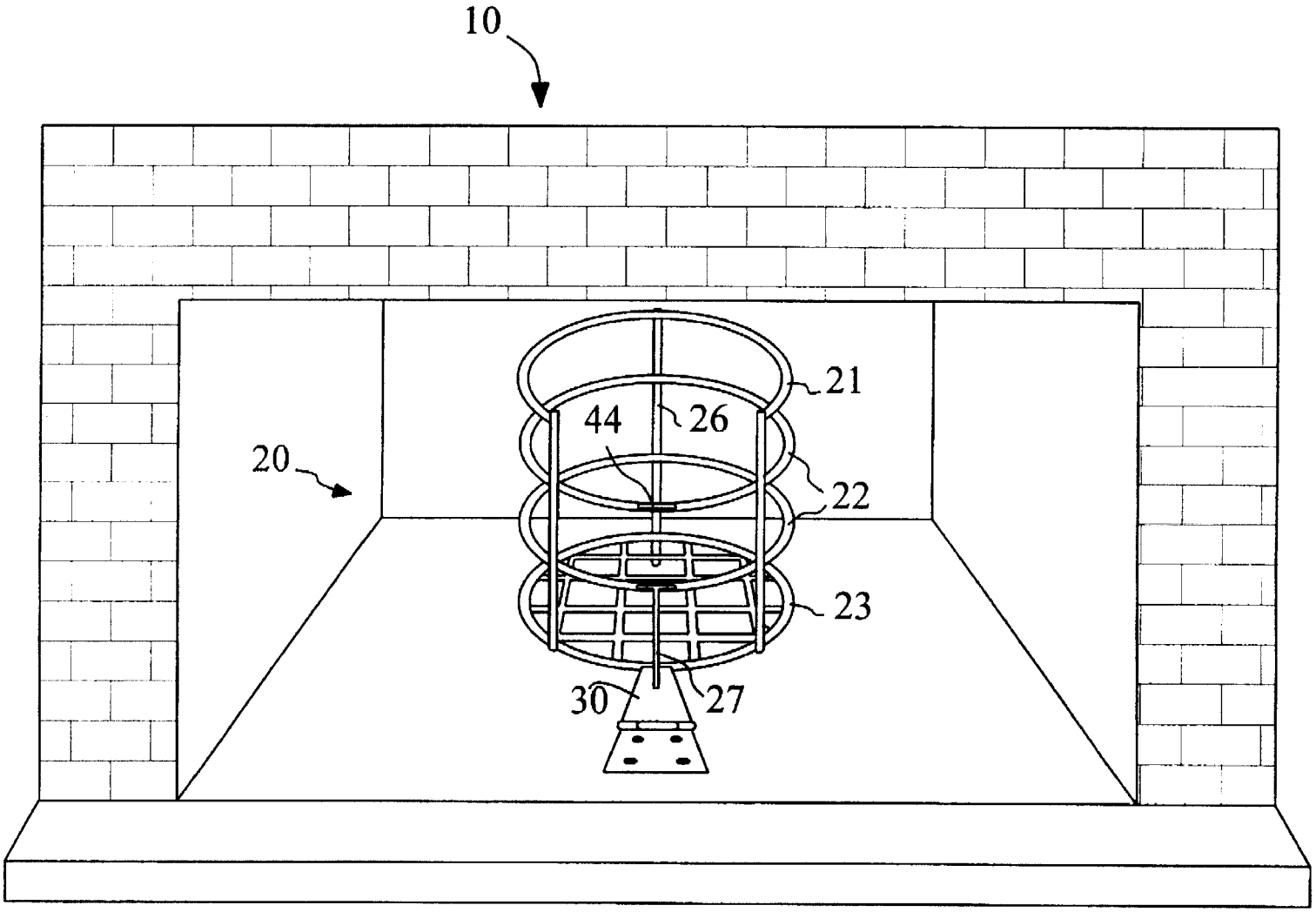
FIG. 6 is a perspective view of an alternative embodiment of the invention.

Vertical wood holder 20 includes means for tilting vertical wood holder 20 to facilitate the placement of firewood within the vertical wood holder 20. In the preferred embodiment of the invention, the means for tilting is accomplished most simply by the arrangement and configuration of legs 24, 25 and 26 in connection with a removable handle. As show in the figures, legs 24, 25 and 26 are arranged so that legs 24 and 25 are located along a line parallel to the hearth or other fireplace opening. In this manner, vertical wood holder 20 may be tilted on legs 24 and 25 to facilitate the placement of firewood within the vertical wood holder 20. A hinge 30 can also be employed between wood holder 20 and the base of the firebox to help stabilize wood holder 20 during tilting and prevent it from toppling. Here, one hinge plate of hinge 30 is welded or otherwise attached to bottom ring 23 while the other hinge plate is fixed to the base of the firebox. FIG. 6 shows an alternative embodiment of the invention which uses only the hinge and one leg to support the wood holder. The rings are held in place by vertical members similar to those which form the vertical extensions of the legs of the preferred embodiment.

Figure 5:
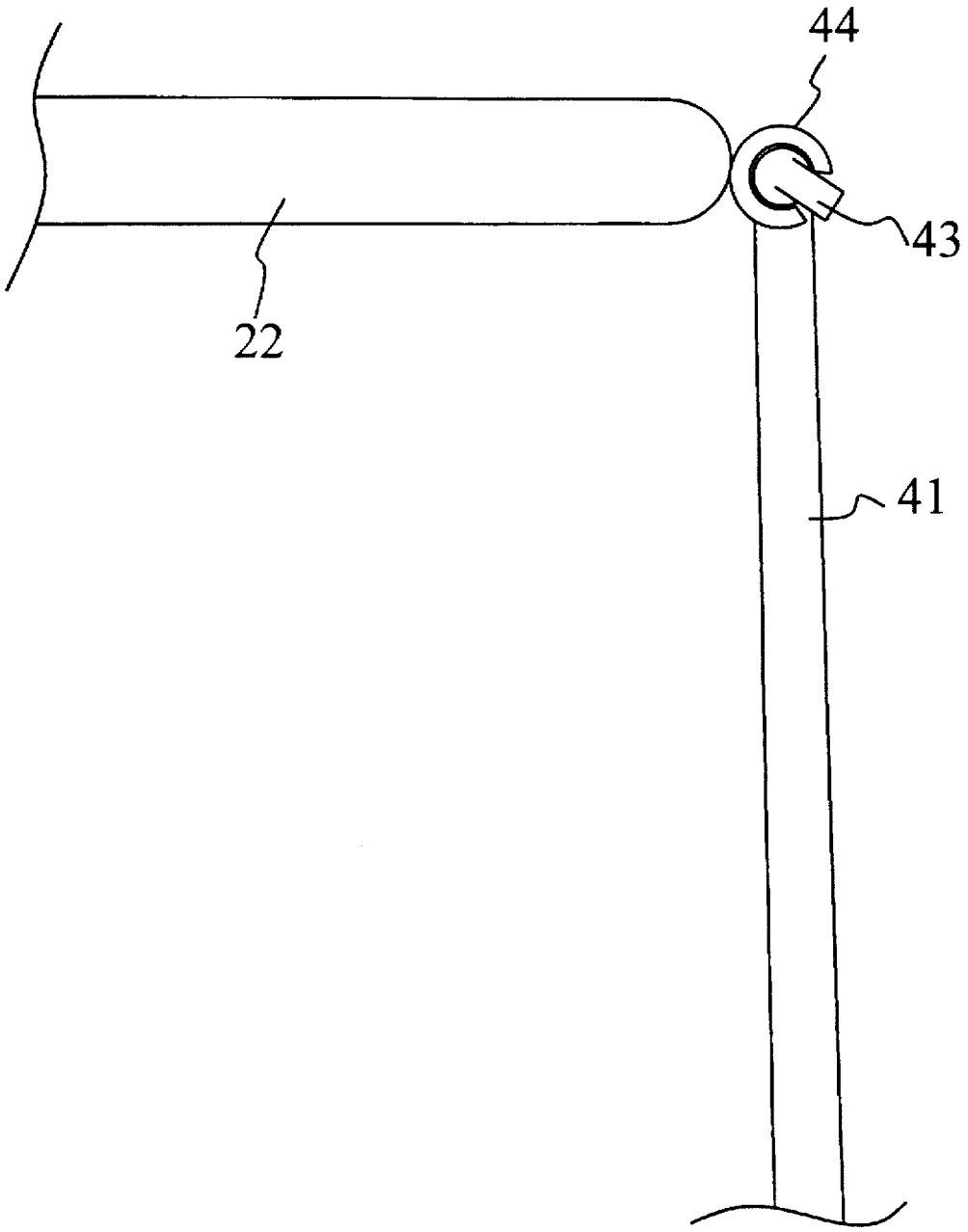
FIG. 5 is a side detail view of the connection mechanism between the removable handle and the wood holder, illustrating the alignment of the slotted sleeve and the handle dog.

Handle 40 has an elongated member 41 including a thermally insulated hand grip 45 attached at a first end of elongated member 41 and an arm 42 extending perpendicularly from its second end. Arm 42 has a dog 43 perpendicularly projecting from the arm's distal end at an angle, with respect to the longitudinal axis of elongated member 41, which is approximately equal to the angle that the slot in slotted connector sleeve 44 makes with respect to a vertical plane, as is best shown in FIG. 5. This feature prevents handle 40 from being removed when wood holder 20 is in any position other than vertical. Slotted connector sleeve 44 is located on the front face of the top most middle ring 22 and is manufactured having an inside diameter which is slightly larger than the diameter of arm 42 allowing arm 42 to slide and rotate freely within connector 44. The length of handle 20 is advantageously long enough to remove the user from the intense heat immediately adjacent to the firebox and can also be set so that handle 20 acts as a third leg of a tripod when vertical wood holder 20 is tipped into the filling position.

Alternatively, a pivotal stub leg 27 is pivotally attached to the front face of the lowest middle ring 22. Stub leg 27 is sized and configured to pivot out to a vertical orientation due to gravity when wood holder 20 is tilted into the filling position to act as the third leg of a tripod with the wood holder resting in the filling position. A pivot stop dog can also be added to prevent the stub leg from pivoting past vertical.

Figure 3:
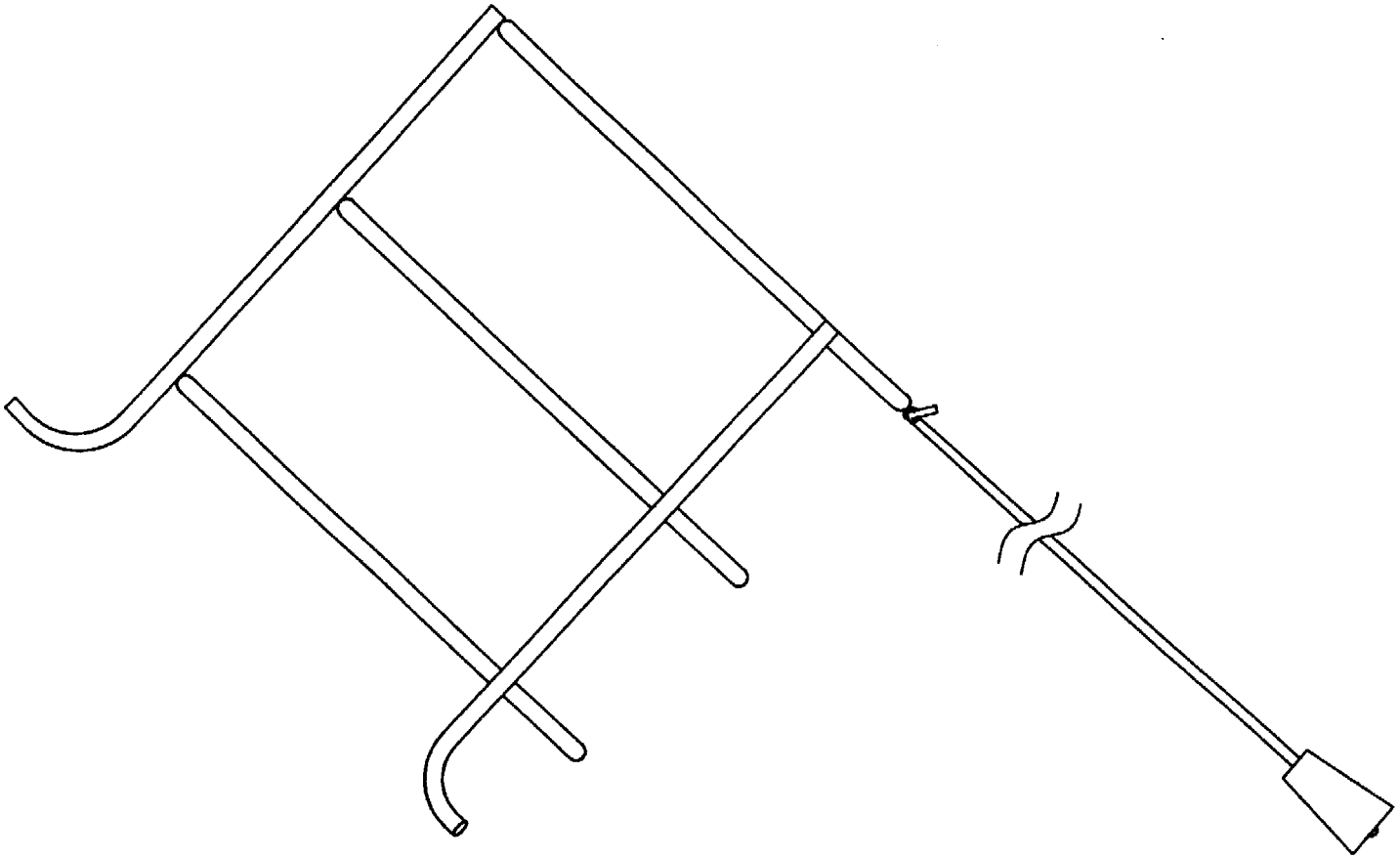
FIG. 3 is a side view of the embodiment depicted in FIGS. 1 and 2 but shown in the tilted reloading position.
Figure 4:
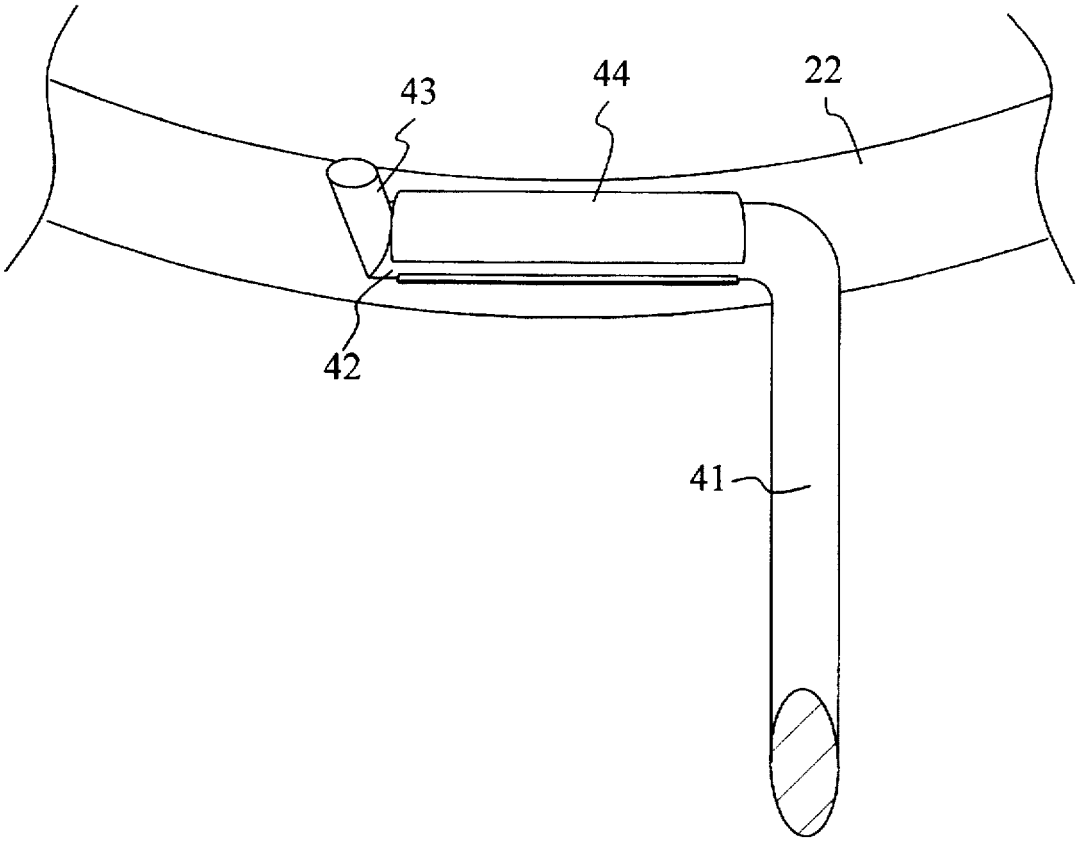
FIG. 4 is a detail view of the connection mechanism between the removable handle and the wood holder.

In use, as shown in FIG. 3, dog 43 engages the slot in slotted connector 44 and arm 42 is projected through connector 44 until dog 43 is passed completely through the slot. At this point arm 42 is free to rotate within keeper 44 until the point at which dog 43 contacts the face of middle ring 22, at which point, arm 42 and hence elongated member 40 are restricted from further rotation. In this position elongated member 40 can serve as a third bearing point together with the lower ends of legs 24 and 25 providing a stable tripod configuration which allows a user to have both hands free to load firewood or other combustibles into vertical wood holder 10, or stub leg 27 can serve as the third bearing point.

Firewood is placed within vertical wood holder 10 in the position shown in FIG. 3. Arm 40 is then grasped at handle 45 and vertical wood holder 10 is returned to the vertical position. In the vertical position, arm 42 and its attached dog 43 are free to be withdrawn from slotted connector 44. The firewood is now oriented in the vertical position so that the firewood's fibers and water-conducting channels are oriented substantially up and down, allowing a more complete and therefore efficient combustion of the firewood.

Although this invention has been described above with reference to particular means, materials and embodiments, it is to be understood that the invention is not limited to these disclosed particulars, but extends instead to all equivalents within the scope of the following claims.

I claim:

1. A vertical fuel holder for fireplaces and wood stoves having a firebox floor which comprises:

a generally cylindrical container being generally open and supported in a vertical orientation above the fire box floor by at least three legs;

a plurality of rings held in substantially parallel spaced apart relation by vertical extensions of the legs;

a grate member being attached to a bottom most ring and disposed generally in a horizontal plane; and an elongated handle being removably attached to a point located near an upper end of the fuel holder to facilitate tilting of the fuel holder to a loading position.

2. The fuel holder of claim 1 further comprising a pivotal stub leg being pivotally attached to the fuel holder at a point between the bottom most ring and the point of attachment for the removable handle.

3. A vertical fuel holder for fireplaces and wood stoves having a firebox floor which comprises:

a generally cylindrical container being generally open and supported in a vertical orientation above the firebox floor by a hinge and at least one leg; and the hinge having a first hinge plate attached to the container at a point near its bottom and a second hinge plate hingedly attached to the first hinge plate and fixable to the firebox floor.

4. The fuel holder of claim 3 wherein the cylindrical container comprises:

a plurality of rings held in substantially parallel spaced apart relation by a plurality of vertical members; and a grate member being attached to a bottom most ring and disposed generally in a horizontal plane.

5. The fuel holder of claim 4 further comprising an elongated handle being removably attachable to a point located near an upper end of the fuel holder to facilitate tilting of the fuel holder to a loading position.

6. The fuel holder of claim 5 further comprising a pivotal stub leg being pivotally attached to the fuel holder at a point between the bottom most ring and the point of attachment for the removable handle.

* * * * *